US009585217B2

(12) United States Patent
Peng

(10) Patent No.: US 9,585,217 B2
(45) Date of Patent: Feb. 28, 2017

(54) LIGHT EMITTING DIODE DRIVING SYSTEM WITH CARRIER SIGNAL CONTROL

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 65 days.

(21) Appl. No.: 14/303,344

(22) Filed: Jun. 12, 2014

(65) Prior Publication Data

US 2015/0289330 A1 Oct. 8, 2015

(30) Foreign Application Priority Data

Apr. 2, 2014 (TW) ..... 103112236 A

(51) Int. Cl.
*H05B 33/08* (2006.01)
*H05B 37/02* (2006.01)

(52) U.S. Cl.
CPC ..... *H05B 33/0845* (2013.01); *H05B 37/0263* (2013.01)

(58) Field of Classification Search
CPC ..... H05B 33/0803; H05B 33/0857; H05B 33/0842; H05B 37/0245; H05B 33/0839; H05B 37/0263; H05B 33/0815; H01L 27/0285

(Continued)

(56) References Cited

U.S. PATENT DOCUMENTS 8,344,659 B2 * 1/2013 Shimomura ..... H05B 37/0245 315/169.3
9,060,395 B1 * 6/2015 Peng ..... H05B 33/0809
(Continued)

FOREIGN PATENT DOCUMENTS

TW M368010 11/2009
TW I407832 B1 9/2013
(Continued)

OTHER PUBLICATIONS

Patrick, Dale R. Fardo, Stephen W. (2008). Electricity and Electronics Fundamentals (2nd Edition)—4. Electronic Circuits. Fairmont Press, Inc.. Online version available at: http://app.knovel.com/hotlink/pdf/id:kt00BXAF73/electricity-electronics/electricit-electronic.*

*Primary Examiner* — Alexander H Taningco
*Assistant Examiner* — Renan Luque
(74) *Attorney, Agent, or Firm* — Muncy, Geissler, Olds & Lowe, P.C.

(57) ABSTRACT

A rectifier rectifies an alternating current power to obtain a direct current power. The rectifier sends the direct current power to a driving power and carrier signal generation apparatus. The driving power and carrier signal generation apparatus generates a driving power. The driving power and carrier signal generation apparatus sends the driving power through a transmission line to at least a light emitting diode driving apparatus to drive at least a light emitting diode. The driving power and carrier signal generation apparatus generates a carrier signal. The driving power and carrier signal generation apparatus sends the carrier signal through the transmission line to the light emitting diode driving apparatuses. The light emitting diode driving apparatuses drive the light emitting diodes according to the carrier signals.

11 Claims, 18 Drawing Sheets

(58) Field of Classification Search
USPC . 315/290–295, 191–195, 243, 307; 361/91.1
See application file for complete search history.

(56) References Cited

U.S. PATENT DOCUMENTS

| | | | | |
|---|---|---|---|---|
| 2006/0092590 | A1* | 5/2006 | Chuang | H01L 27/0285 361/91.1 |
| 2010/0013396 | A1* | 1/2010 | Peng | H05B 37/0263 315/192 |
| 2011/0109228 | A1* | 5/2011 | Shimomura | H05B 37/0245 315/113 |

FOREIGN PATENT DOCUMENTS

| | | |
|---|---|---|
| TW | M469712 | 1/2014 |
| TW | M473025 U | 2/2014 |

* cited by examiner

LIGHT EMITTING DIODE DRIVING SYSTEM WITH CARRIER SIGNAL CONTROL

BACKGROUND OF THE INVENTION

Field of the Invention

The present invention relates to a light emitting diode driving system, and especially relates to a light emitting diode driving system with carrier signal control.

Description of the Related Art

Nowadays, the connection types of the light emitting diode lamp string modules are separated into two types: the serial-type connection and the parallel-type connection. The light emitting diode lamp string modules are widely used for external walls of the building, decoration of trees, signboards, and scenery designing.

In the related art serial-type light emitting diode lamp string modules, a plurality of light emitting diode lamp string modules are commonly connected in series. Also, the amount of the light emitting diode lamp string modules is determined according to the volume of the decorated objects. In addition, all of the light emitting diode lamp string modules are controlled by the same controller which initially controls the first light emitting diode lamp string module.

Although the light emitting diode lamp string modules are easily connected together, the remaining light emitting diode lamp string modules behind the abnormal light emitting diode lamp string module cannot be lighted even only one of the light emitting diode lamp string modules is abnormal. That is because the control signal cannot be sent to drive all of the remaining light emitting diode lamp string modules.

The parallel-type light emitting diode lamp string modules are connected to the controller in parallel. Accordingly, each one of the light emitting diode lamp string modules is controlled by the controller through a control line and an address line, respectively. For example, ten control lines and ten address lines need to be used when ten light emitting diode lamp string modules are employed to be connected in parallel.

The remaining light emitting diode lamp string modules can still be normally controlled when one of the light emitting diode lamp string modules is abnormal. However, the amount of the control lines and the address lines increase proportionally. Therefore, complexity and the costs of the equipment also increase when the amount of the light emitting diode lamp string modules increases.

No matter the connection type of the light emitting diode lamp string modules is the serial-type or the parallel-type, many power transmission lines and signal transmission lines need to be used to control the colors and intensities of the light emitting diode lamp string modules. Accordingly, cost down can be achieved only if the amount of the power transmission lines or the signal transmission lines can be reduced.

SUMMARY OF THE INVENTION

In order to solve the above-mentioned problems, an object of the present invention is to provide a light emitting diode driving system with carrier signal control.

In order to achieve the object of the present invention mentioned above, the light emitting diode driving system is applied to a rectifier and at least a light emitting diode. The light emitting diode driving system comprises a driving power and carrier signal generation apparatus, a transmission line and at least a light emitting diode driving apparatus. The driving power and carrier signal generation apparatus is electrically connected to the rectifier. The transmission line is electrically connected to the driving power and carrier signal generation apparatus. The light emitting diode driving apparatus is electrically connected to the transmission line, the driving power and carrier signal generation apparatus and the light emitting diode. The light emitting diode driving apparatus comprises a power positive terminal, a voltage regulator, a power negative terminal, a signal detector, an identification control logic circuit, a counting and shift-registering circuit, a light changing control circuit, a comparison circuit, an address memory unit and an address register. The power positive terminal is electrically connected to the driving power and carrier signal generation apparatus. The voltage regulator is electrically connected to the power positive terminal. The power negative terminal is electrically connected to the voltage regulator. The signal detector is electrically connected to the power positive terminal. The identification control logic circuit is electrically connected to the voltage regulator, the power negative terminal and the signal detector. The counting and shift-registering circuit is electrically connected to the voltage regulator, the power negative terminal and the identification control logic circuit. The light changing control circuit is electrically connected to the voltage regulator, the power negative terminal and the counting and shift-registering circuit. The comparison circuit is electrically connected to the identification control logic circuit. The address memory unit is electrically connected to the comparison circuit. The address register is electrically connected to the identification control logic circuit. The rectifier rectifies an alternating current power to obtain a direct current power. The rectifier sends the direct current power to the driving power and carrier signal generation apparatus. The driving power and carrier signal generation apparatus generates a driving power. The driving power and carrier signal generation apparatus sends the driving power through the transmission line to the light emitting diode driving apparatuses to drive the light emitting diodes. The driving power and carrier signal generation apparatus generates a carrier signal. The driving power and carrier signal generation apparatus sends the carrier signal through the transmission line to the light emitting diode driving apparatuses. The light emitting diode driving apparatuses drive the light emitting diodes according to the carrier signals.

The efficiency of the present invention is to reduce the transmission lines of the light emitting diode lamp. Therefore, the cost of the light emitting diode lamp is reduced.

DETAILED DESCRIPTION OF THE INVENTION

Figure 1:
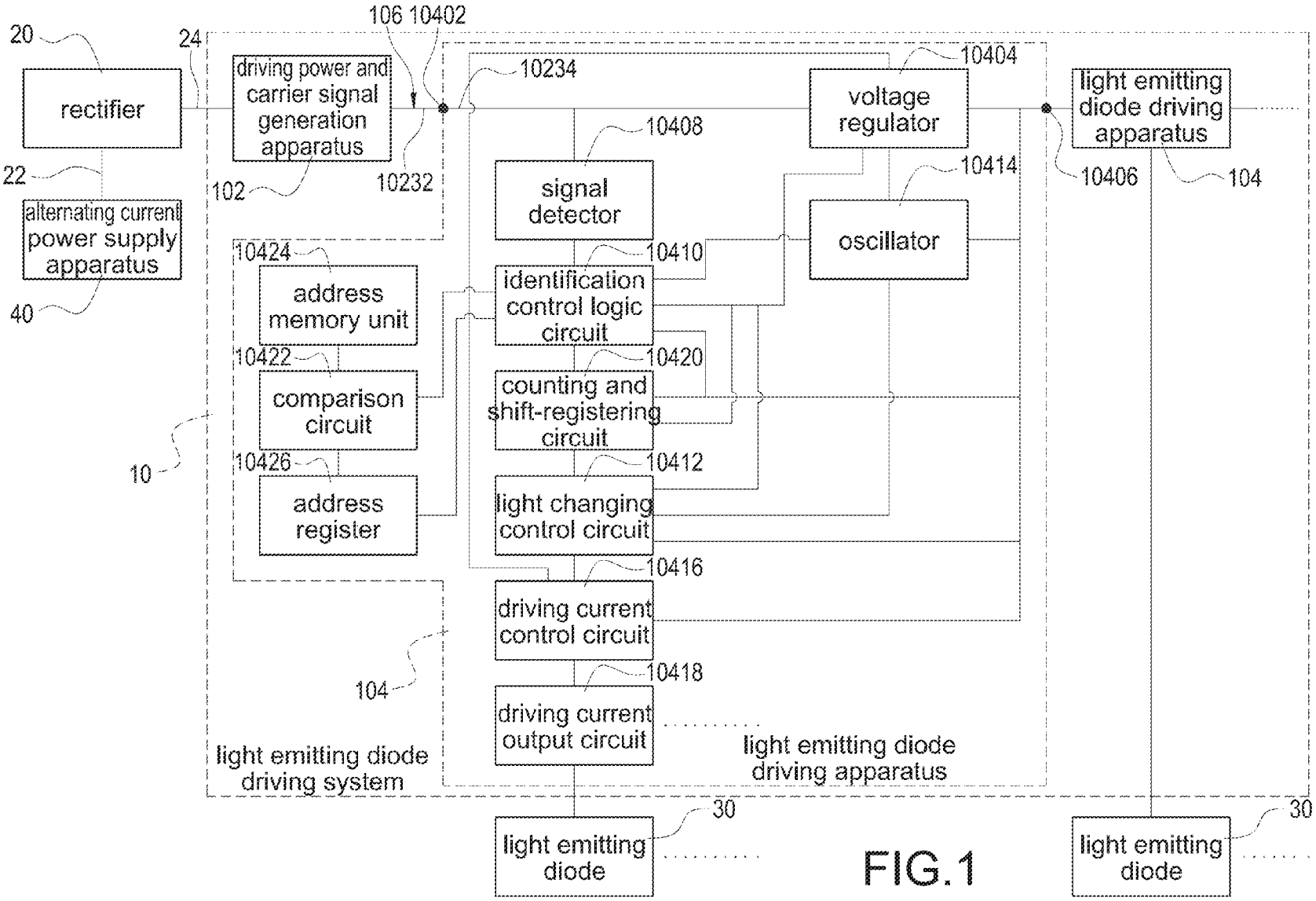
FIG. 1 shows a block diagram of the light emitting diode driving system with carrier signal control of the present invention.

FIG. 1 shows a block diagram of the light emitting diode driving system with carrier signal control of the present invention. A light emitting diode driving system 10 with carrier signal control is applied to a rectifier 20 (in an alternating current condition or direct current condition) and at least a light emitting diode 30. The light emitting diode driving system 10 comprises a driving power and carrier signal generation apparatus 102, a transmission line 106 and at least a light emitting diode driving apparatus 104. The rectifier 20 and the driving power and carrier signal generation apparatus 102 are integrated as a power supply.

The driving power and carrier signal generation apparatus 102 is electrically connected to the rectifier 20. The transmission line 106 is electrically connected to the driving power and carrier signal generation apparatus 102. The light emitting diode driving apparatuses 104 are electrically connected to the transmission line 106, the driving power and carrier signal generation apparatus 102 and the light emitting diodes 30.

The rectifier 20 rectifies an alternating current power 22 (sent from an alternating current power supply apparatus 40) to obtain a direct current power 24. The rectifier 20 sends the direct current power 24 to the driving power and carrier signal generation apparatus 102. The driving power and carrier signal generation apparatus 102 generates a driving power 10232. The driving power and carrier signal generation apparatus 102 sends the driving power 10232 through the transmission line 106 to the light emitting diode driving apparatuses 104 to drive the light emitting diodes 30.

The driving power and carrier signal generation apparatus 102 generates a carrier signal 10234. The driving power and carrier signal generation apparatus 102 sends the carrier signal 10234 through the transmission line 106 to the light emitting diode driving apparatuses 104. The light emitting diode driving apparatuses 104 drive the light emitting diodes 30 according to the carrier signals 10234.

The carrier signal 10234 is, for example but not limited to, a pulse wave. A voltage value of the pulse wave can be positive or negative. The transmission line 106 carries the driving power 10232 and the carrier signal 10234 at the same time. Therefore, the transmission lines of the light emitting diode lamp are reduced and the cost of the light emitting diode lamp is reduced.

The light emitting diode driving apparatus 104 comprises a power positive terminal 10402, a voltage regulator 10404, a power negative terminal 10406, a signal detector 10408, an identification control logic circuit 10410, a light changing control circuit 10412, an oscillator 10414, a driving current control circuit 10416, at least a driving current output circuit 10418, a counting and shift-registering circuit 10420, a comparison circuit 10422, an address memory unit 10424 and an address register 10426.

The power positive terminal 10402 is electrically connected to the driving power and carrier signal generation apparatus 102. The voltage regulator 10404 is electrically connected to the power positive terminal 10402. The power negative terminal 10406 is electrically connected to the voltage regulator 10404. The signal detector 10408 is electrically connected to the power positive terminal 10402. The identification control logic circuit 10410 is electrically connected to the voltage regulator 10404, the power negative terminal 10406 and the signal detector 10408. The light changing control circuit 10412 is electrically connected to the voltage regulator 10404, the power negative terminal 10406 and the counting and shift-registering circuit 10420.

The counting and shift-registering circuit 10420 is electrically connected to the voltage regulator 10404, the power negative terminal 10406 and the identification control logic circuit 10410. The comparison circuit 10422 is electrically connected to the identification control logic circuit 10410. The address memory unit 10424 is electrically connected to the comparison circuit 10422. The address register 10426 is electrically connected to the identification control logic circuit 10410.

The oscillator 10414 is electrically connected to the voltage regulator 10404, the power negative terminal 10406, the identification control logic circuit 10410 and the light changing control circuit 10412. The driving current control circuit 10416 is electrically connected to the voltage regulator 10404, the power negative terminal 10406 and the light changing control circuit 10412. The driving current output circuits 10418 are electrically connected to the driving current control circuit 10416 and the light emitting diodes 30.

The signal detector 10408 detects the carrier signal 10234 and then the signal detector 10408 informs the identification control logic circuit 10410. Then, the identification control logic circuit 10410, the comparison circuit 10422, the address memory unit 10424 and the address register 10426 are configured to control and process circuit logic and then the counting and shift-registering circuit 10420 informs the light changing control circuit 10412. The light changing control circuit 10412 is configured to determine the colors and intensities of the light emitting diodes 30 and then the light changing control circuit 10412 informs the driving current control circuit 10416. Finally, the driving current control circuit 10416 is configured to control the driving current output circuit 10418 to drive the light emitting diodes 30.

Figure 2:
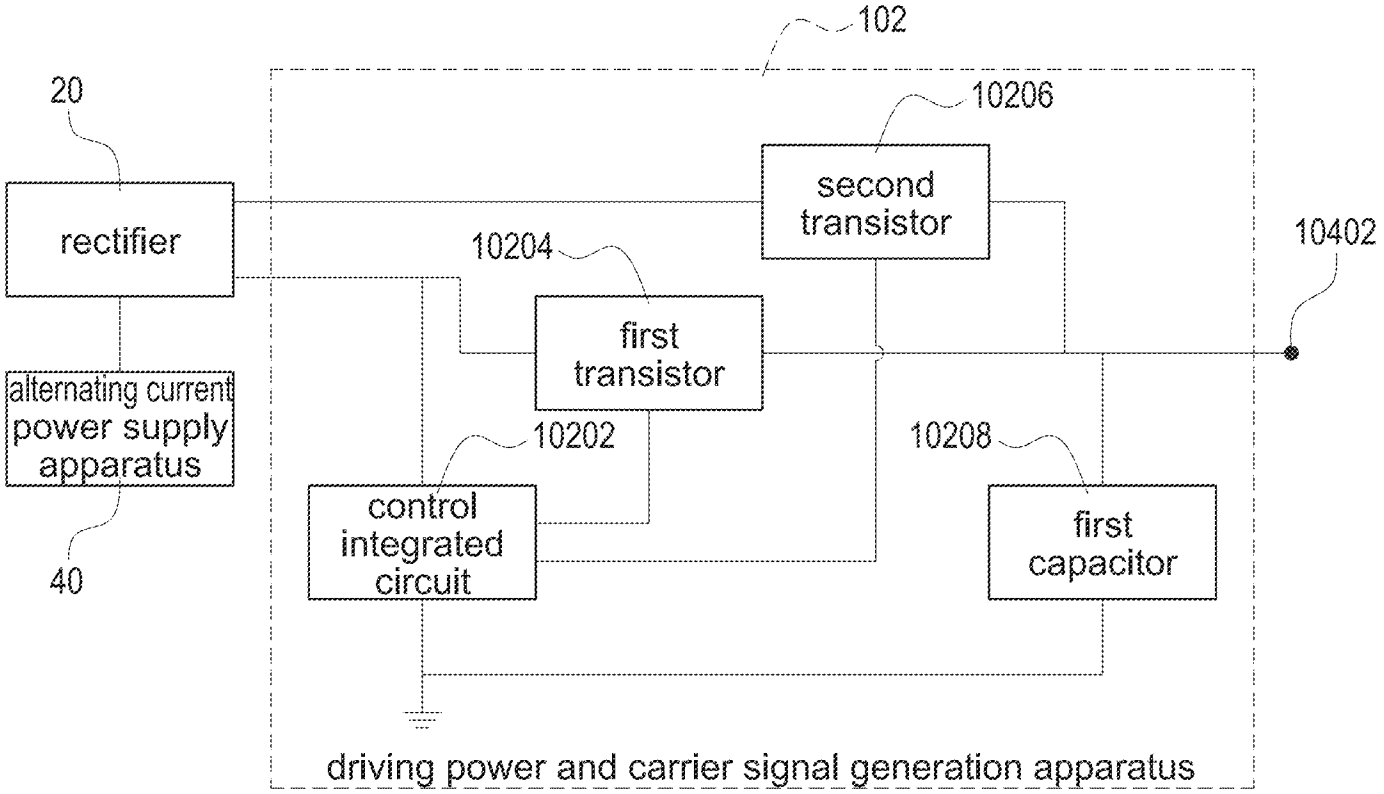
FIG. 2 shows a block diagram of the first embodiment of the driving power and carrier signal generation apparatus of the present invention.

FIG. 2 shows a block diagram of the first embodiment of the driving power and carrier signal generation apparatus of the present invention. The driving power and carrier signal generation apparatus 102 comprises a control integrated circuit 10202, a first transistor 10204, a second transistor 10206 and a first capacitor 10208.

The control integrated circuit 10202 is electrically connected to the rectifier 20. The first transistor 10204 is electrically connected to the rectifier 20, the power positive terminal 10402 and the control integrated circuit 10202. The second transistor 10206 is electrically connected to the rectifier 20, the power positive terminal 10402 and the control integrated circuit 10202. The first capacitor 10208 is electrically connected to the first transistor 10204, the second transistor 10206 and the power positive terminal 10402.

Figure 3:
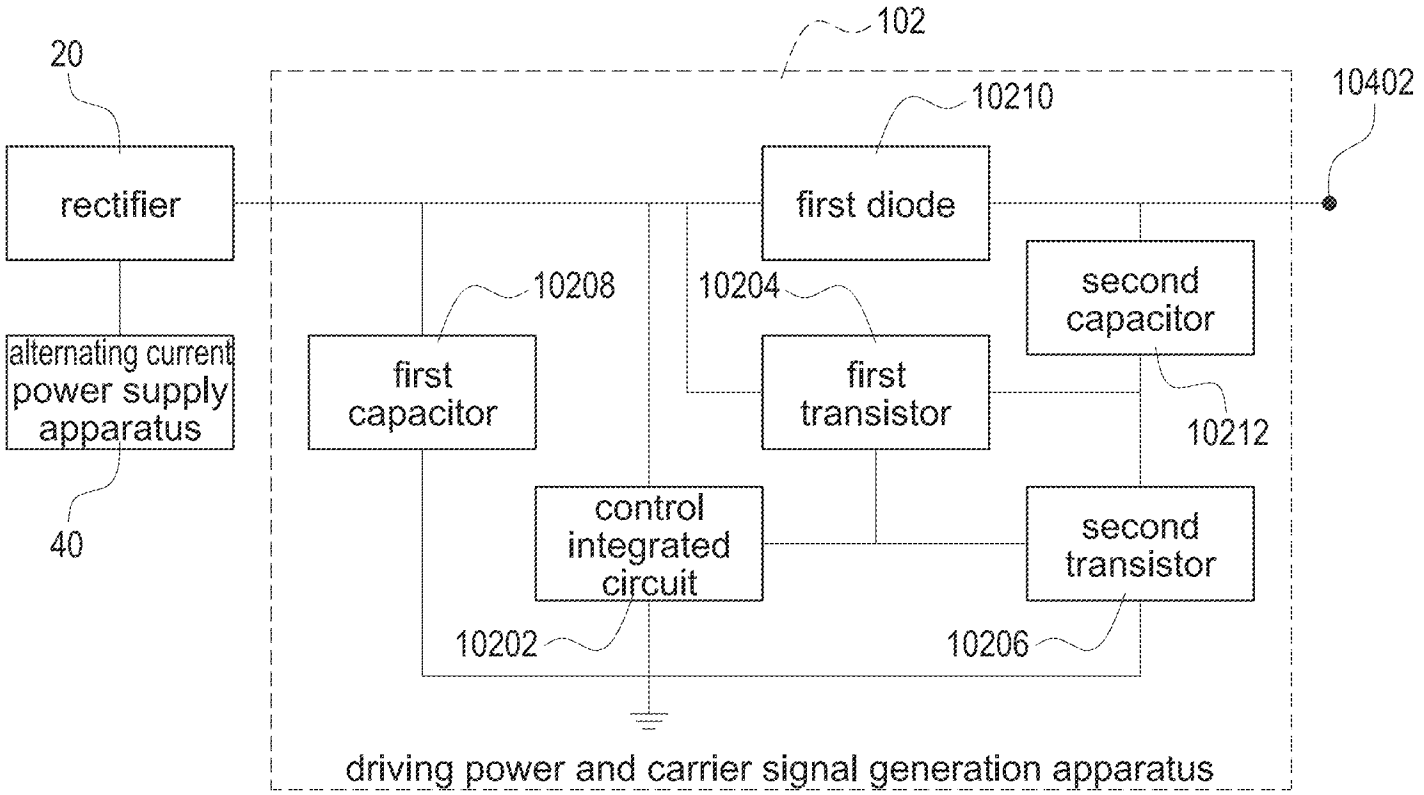
FIG. 3 shows a block diagram of the second embodiment of the driving power and carrier signal generation apparatus of the present invention.

FIG. 3 shows a block diagram of the second embodiment of the driving power and carrier signal generation apparatus of the present invention. The driving power and carrier signal generation apparatus 102 comprises a control integrated circuit 10202, a first transistor 10204, a second transistor 10206, a first capacitor 10208, a first diode 10210 and a second capacitor 10212.

The control integrated circuit 10202 is electrically connected to the rectifier 20. The first transistor 10204 is electrically connected to the rectifier 20 and the control integrated circuit 10202. The second transistor 10206 is electrically connected to the control integrated circuit 10202 and the first transistor 10204. The first capacitor 10208 is electrically connected to the rectifier 20 and the control integrated circuit 10202. The first diode 10210 is electrically connected to the rectifier 20, the power positive terminal 10402 and the control integrated circuit 10202. The second capacitor 10212 is electrically connected to the first diode 10210 and the power positive terminal 10402.

Figure 4:
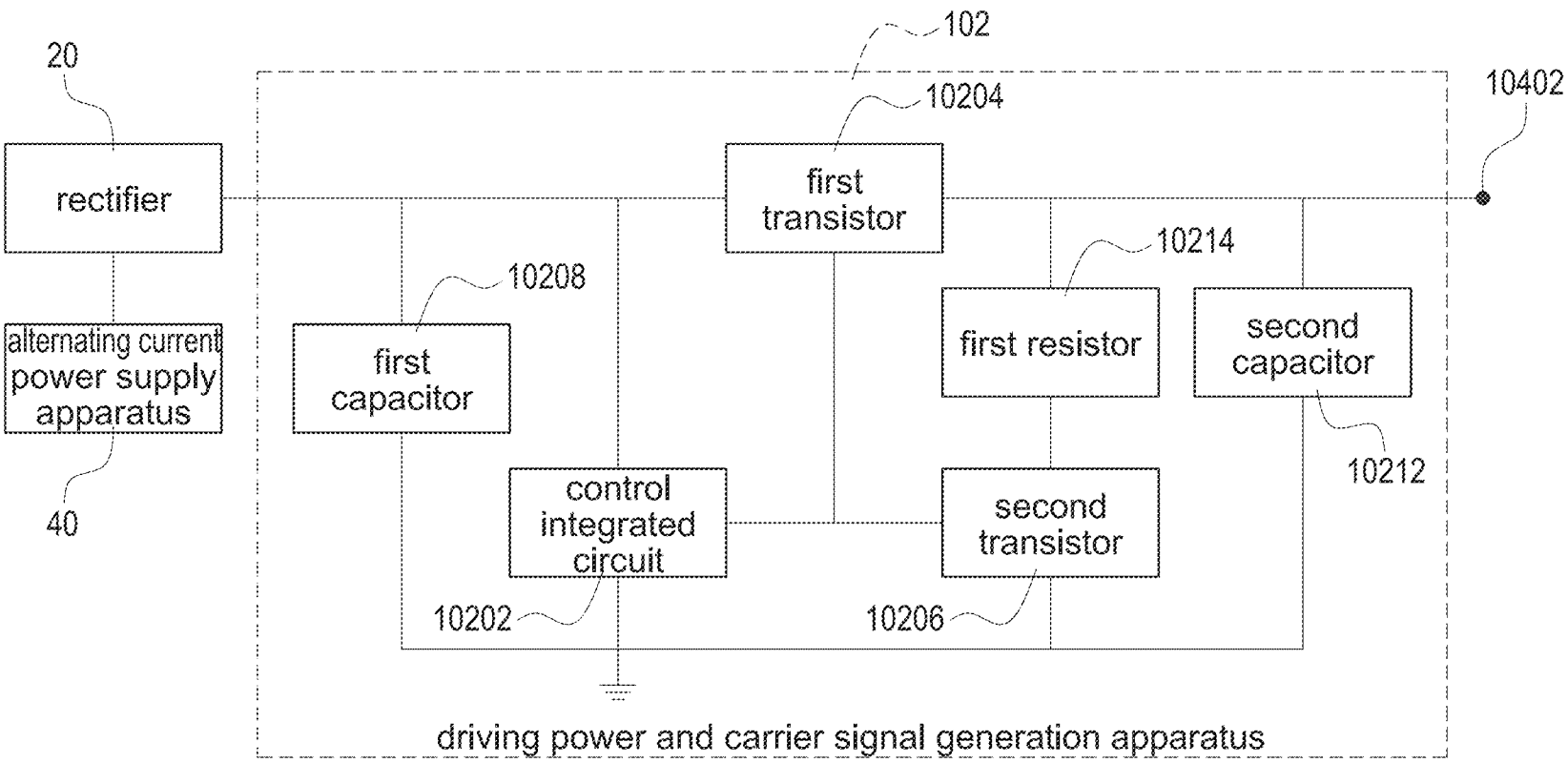
FIG. 4 shows a block diagram of the third embodiment of the driving power and carrier signal generation apparatus of the present invention.

FIG. 4 shows a block diagram of the third embodiment of the driving power and carrier signal generation apparatus of the present invention. The driving power and carrier signal generation apparatus 102 comprises a control integrated circuit 10202, a first transistor 10204, a second transistor 10206, a first capacitor 10208, a second capacitor 10212 and a first resistor 10214.

The control integrated circuit 10202 is electrically connected to the rectifier 20. The first transistor 10204 is electrically connected to the rectifier 20 and the control integrated circuit 10202. The second transistor 10206 is electrically connected to the control integrated circuit 10202 and the first transistor 10204. The first capacitor 10208 is electrically connected to the rectifier 20 and the control integrated circuit 10202. The second capacitor 10212 is electrically connected to the first transistor 10204 and the power positive terminal 10402. The first resistor 10214 is electrically connected to the first transistor 10204 and the power positive terminal 10402.

Figure 5:
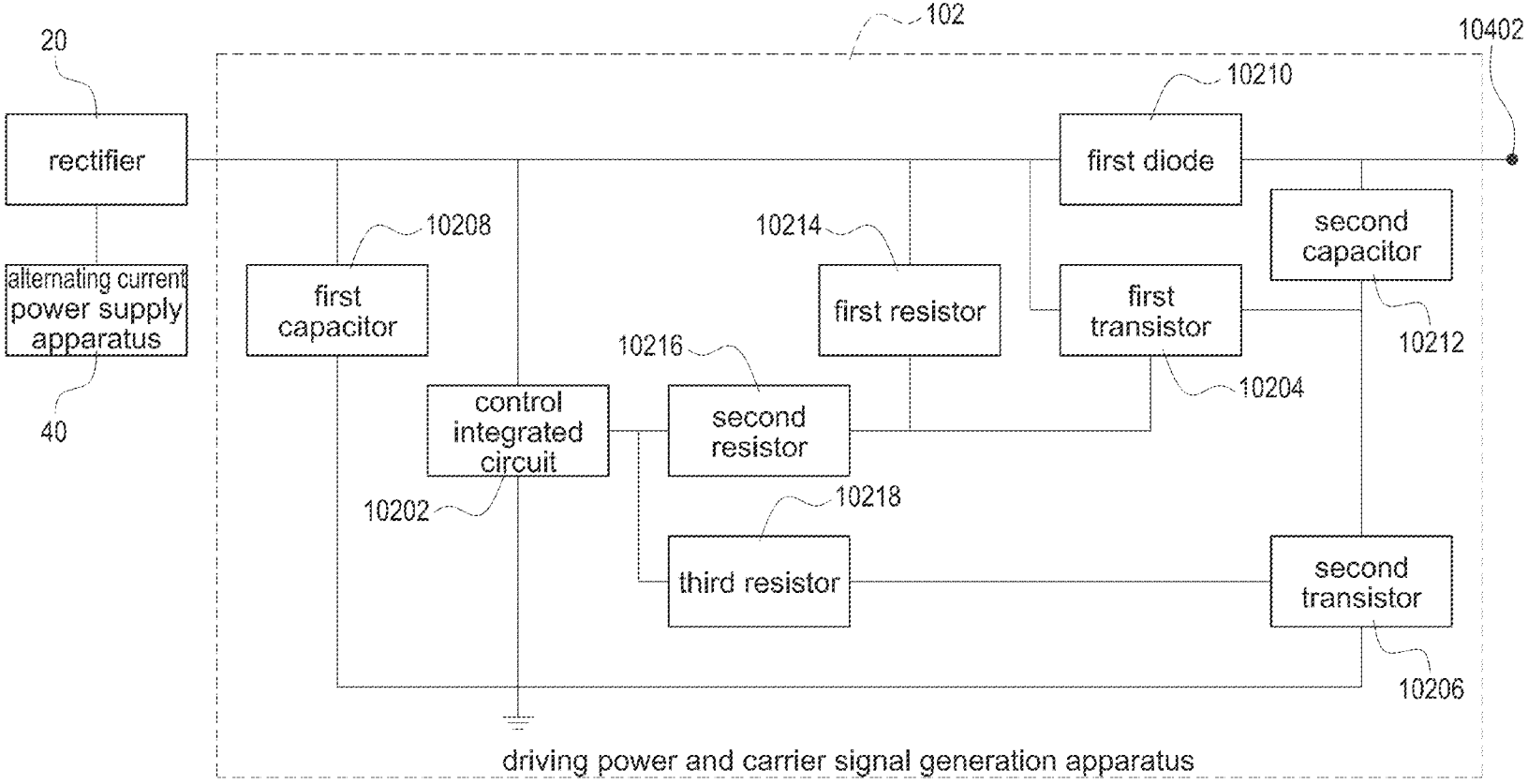
FIG. 5 shows a block diagram of the fourth embodiment of the driving power and carrier signal generation apparatus of the present invention.

FIG. 5 shows a block diagram of the fourth embodiment of the driving power and carrier signal generation apparatus of the present invention. The driving power and carrier signal generation apparatus 102 comprises a control integrated circuit 10202, a first transistor 10204, a second transistor 10206, a first capacitor 10208, a first diode 10210, a second capacitor 10212, a first resistor 10214, a second resistor 10216 and a third resistor 10218.

The control integrated circuit 10202 is electrically connected to the rectifier 20. The first transistor 10204 is electrically connected to the rectifier 20 and the control integrated circuit 10202. The first capacitor 10208 is electrically connected to the rectifier 20 and the control integrated circuit 10202. The first diode 10210 is electrically connected to the rectifier 20, the power positive terminal 10402 and the control integrated circuit 10202. The second capacitor 10212 is electrically connected to the first diode 10210 and the power positive terminal 10402. The second transistor 10206 is electrically connected to the second capacitor 10212. The first resistor 10214 is electrically connected to the rectifier 20 and the control integrated circuit 10202. The second resistor 10216 is electrically connected to the control integrated circuit 10202, the first resistor 10214 and the first transistor 10204. The third resistor 10218 is electrically connected to the control integrated circuit 10202 and the second transistor 10206.

Figure 6:
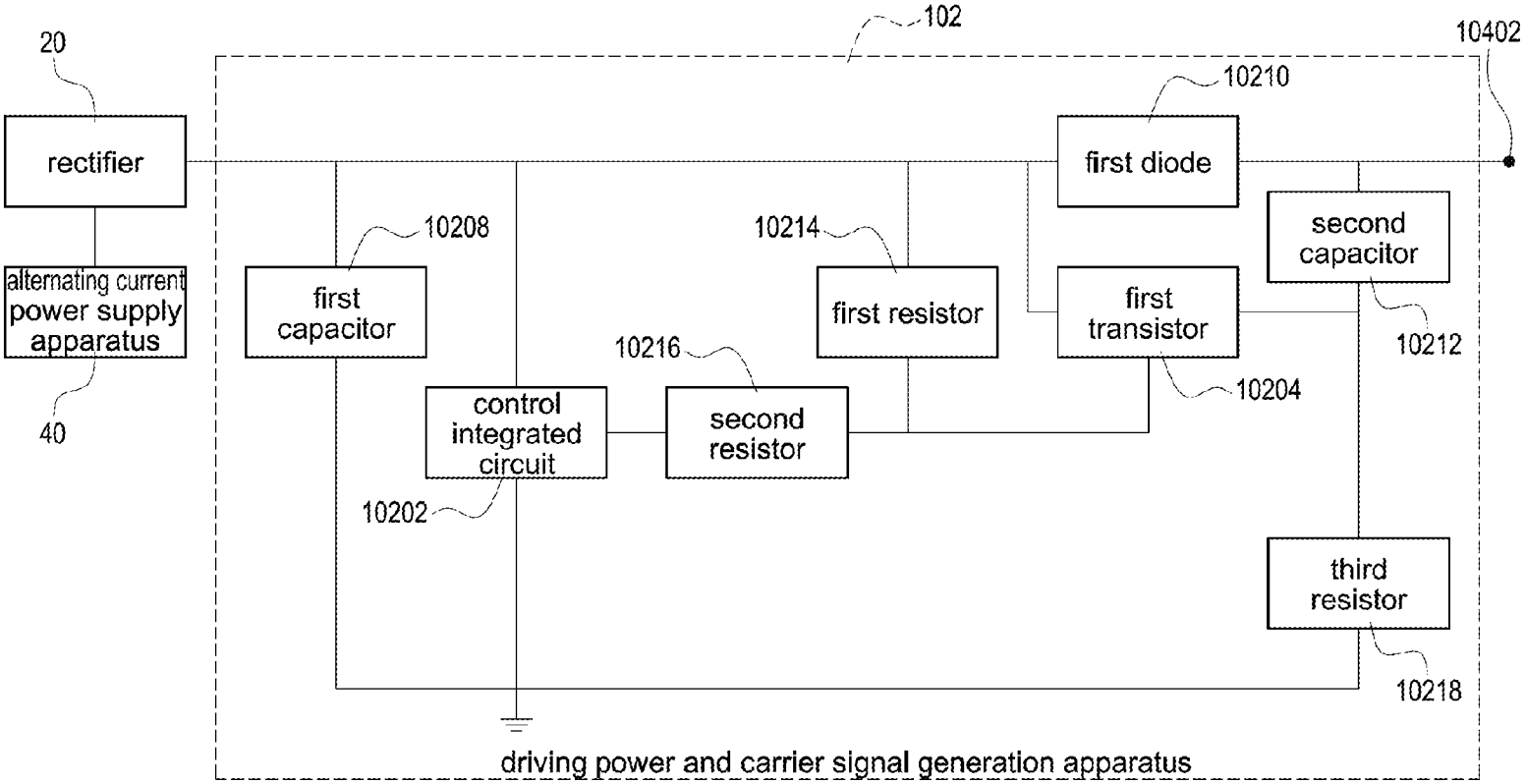
FIG. 6 shows a block diagram of the fifth embodiment of the driving power and carrier signal generation apparatus of the present invention.

FIG. 6 shows a block diagram of the fifth embodiment of the driving power and carrier signal generation apparatus of the present invention. The driving power and carrier signal generation apparatus 102 comprises a control integrated circuit 10202, a first transistor 10204, a first capacitor 10208, a first diode 10210, a second capacitor 10212, a first resistor 10214, a second resistor 10216 and a third resistor 10218.

The control integrated circuit 10202 is electrically connected to the rectifier 20. The first transistor 10204 is electrically connected to the rectifier 20 and the control integrated circuit 10202. The first capacitor 10208 is electrically connected to the rectifier 20 and the control integrated circuit 10202. The first diode 10210 is electrically connected to the rectifier 20, the power positive terminal 10402 and the control integrated circuit 10202. The second capacitor 10212 is electrically connected to the first diode 10210 and the power positive terminal 10402. The first resistor 10214 is electrically connected to the rectifier 20 and the control integrated circuit 10202. The second resistor 10216 is electrically connected to the control integrated circuit 10202, the first resistor 10214 and the first transistor 10204. The third resistor 10218 is electrically connected to the second capacitor 10212.

Figure 7:
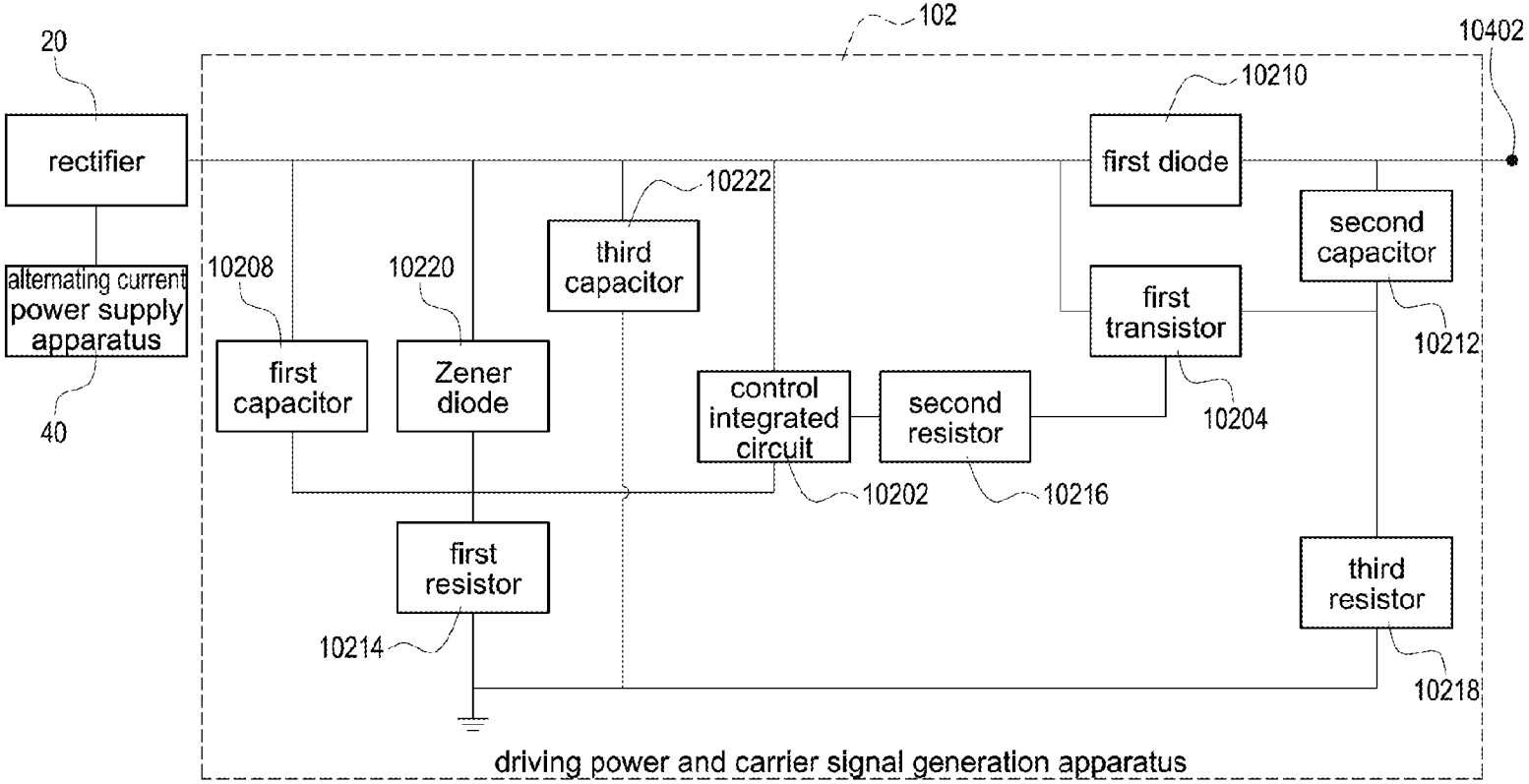
FIG. 7 shows a block diagram of the sixth embodiment of the driving power and carrier signal generation apparatus of the present invention.

FIG. 7 shows a block diagram of the sixth embodiment of the driving power and carrier signal generation apparatus of the present invention. The driving power and carrier signal generation apparatus 102 comprises a control integrated circuit 10202, a first transistor 10204, a first capacitor 10208, a first diode 10210, a second capacitor 10212, a first resistor 10214, a second resistor 10216, a third resistor 10218, a Zener diode 10220 and a third capacitor 10222.

The control integrated circuit 10202 is electrically connected to the rectifier 20. The first transistor 10204 is electrically connected to the rectifier 20 and the control integrated circuit 10202. The first capacitor 10208 is electrically connected to the rectifier 20 and the control integrated circuit 10202. The first diode 10210 is electrically connected to the rectifier 20, the power positive terminal 10402 and the control integrated circuit 10202. The second capacitor 10212 is electrically connected to the first diode 10210 and the power positive terminal 10402. The first resistor 10214 is electrically connected to the first capacitor 10208 and the control integrated circuit 10202. The second resistor 10216 is electrically connected to the control integrated circuit 10202 and the first transistor 10204. The third resistor 10218 is electrically connected to the second capacitor 10212. The Zener diode 10220 is electrically connected to the control integrated circuit 10202, the first capacitor 10208 and the first resistor 10214. The third capacitor 10222 is electrically connected to the rectifier 20 and the control integrated circuit 10202.

Figure 8:
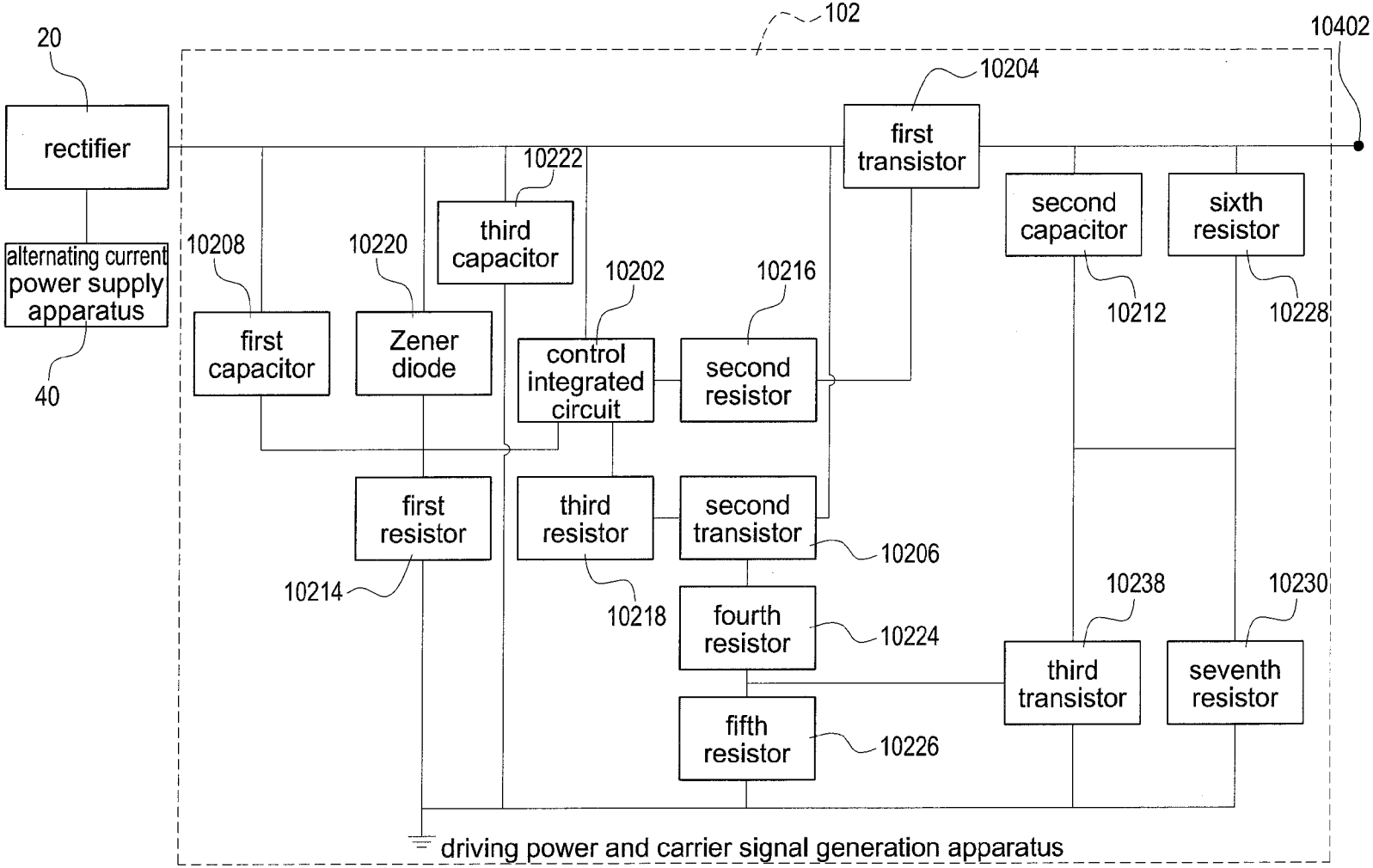
FIG. 8 shows a block diagram of the seventh embodiment of the driving power and carrier signal generation apparatus of the present invention.

FIG. 8 shows a block diagram of the seventh embodiment of the driving power and carrier signal generation apparatus of the present invention. The driving power and carrier signal generation apparatus 102 comprises a control integrated circuit 10202, a first transistor 10204, a second transistor 10206, a first capacitor 10208, a second capacitor 10212, a second resistor 10216, a third resistor 10218, a Zener diode 10220, a third capacitor 10222, a fourth resistor 10224, a fifth resistor 10226, a sixth resistor 10228, a seventh resistor 10230 and a third transistor 10238.

The control integrated circuit 10202 is electrically connected to the rectifier 20. The first transistor 10204 is electrically connected to the rectifier 20 and the control integrated circuit 10202. The first capacitor 10208 is electrically connected to the rectifier 20 and the control integrated circuit 10202. The second capacitor 10212 is electrically connected to the first transistor 10204 and the power positive terminal 10402. The second resistor 10216 is electrically connected to the control integrated circuit 10202 and the first transistor 10204. The third resistor 10218 is electrically connected to the control integrated circuit 10202. The Zener diode 10220 is electrically connected to the control integrated circuit 10202 and the first capacitor 10208. The third capacitor 10222 is electrically connected to the rectifier 20 and the control integrated circuit 10202. The second transistor 10206 is electrically connected to the first transistor 10204. The fourth resistor 10224 is electrically connected to the second transistor 10206. The fifth resistor 10226 is electrically connected to the fourth resistor 10224. The sixth resistor 10228 is electrically connected to the first transistor 10204 and the power positive terminal 10402. The seventh resistor 10230 is electrically connected to the sixth resistor 10228. The third transistor 10238 is electrically connected to the fourth resistor 10224, the fifth resistor 10226 and the second capacitor 10212.

Figure 9:
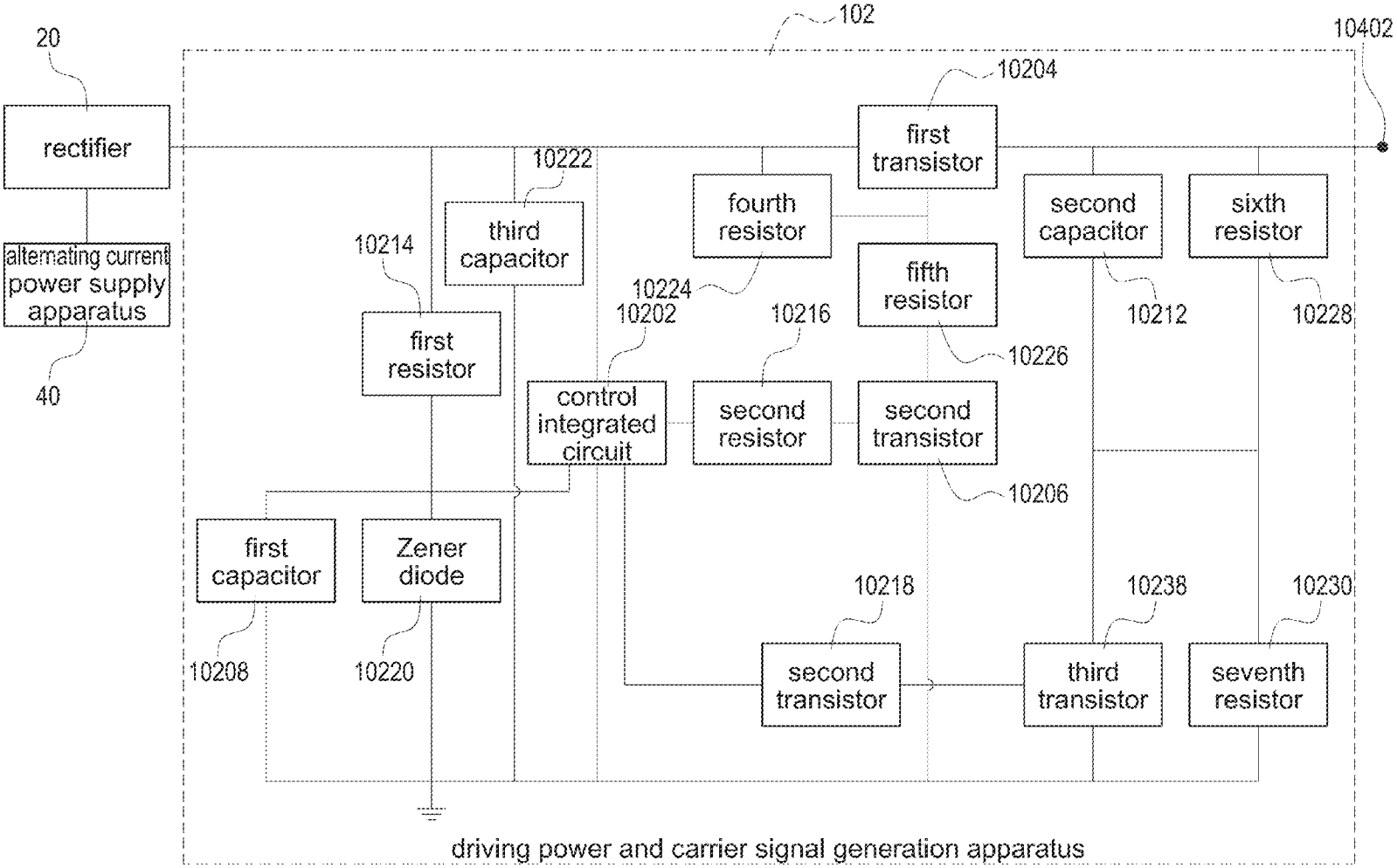
FIG. 9 shows a block diagram of the eighth embodiment of the driving power and carrier signal generation apparatus of the present invention.

FIG. 9 shows a block diagram of the eighth embodiment of the driving power and carrier signal generation apparatus of the present invention. The driving power and carrier signal generation apparatus 102 comprises a control integrated circuit 10202, a first transistor 10204, a second transistor 10206, a first capacitor 10208, a second capacitor 10212, a first resistor 10214, a second resistor 10216, a third resistor 10218, a Zener diode 10220, a third capacitor 10222, a fourth resistor 10224, a fifth resistor 10226, a sixth resistor 10228, a seventh resistor 10230 and a third transistor 10238.

The first resistor 10214 is electrically connected to the rectifier 20. The control integrated circuit 10202 is electrically connected to the first resistor 10214. The first transistor 10204 is electrically connected to the rectifier 20 and the first resistor 10214. The first capacitor 10208 is electrically connected to the first resistor 10214. The second capacitor 10212 is electrically connected to the first transistor 10204 and the power positive terminal 10402. The second resistor 10216 is electrically connected to the control integrated circuit 10202. The third resistor 10218 is electrically connected to the control integrated circuit 10202. The Zener diode 10220 is electrically connected to the first resistor 10214. The third capacitor 10222 is electrically connected to the rectifier 20 and the first resistor 10214. The second transistor 10206 is electrically connected to the second resistor 10216. The fourth resistor 10224 is electrically connected to the first transistor 10204. The fifth resistor 10226 is electrically connected to the fourth resistor 10224, the first transistor 10204 and the second transistor 10206. The sixth resistor 10228 is electrically connected to the first transistor 10204 and the power positive terminal 10402. The seventh resistor 10230 is electrically connected to the sixth resistor 10228. The third transistor 10238 is electrically connected to the third resistor 10218 and the second capacitor 10212.

Figure 10:
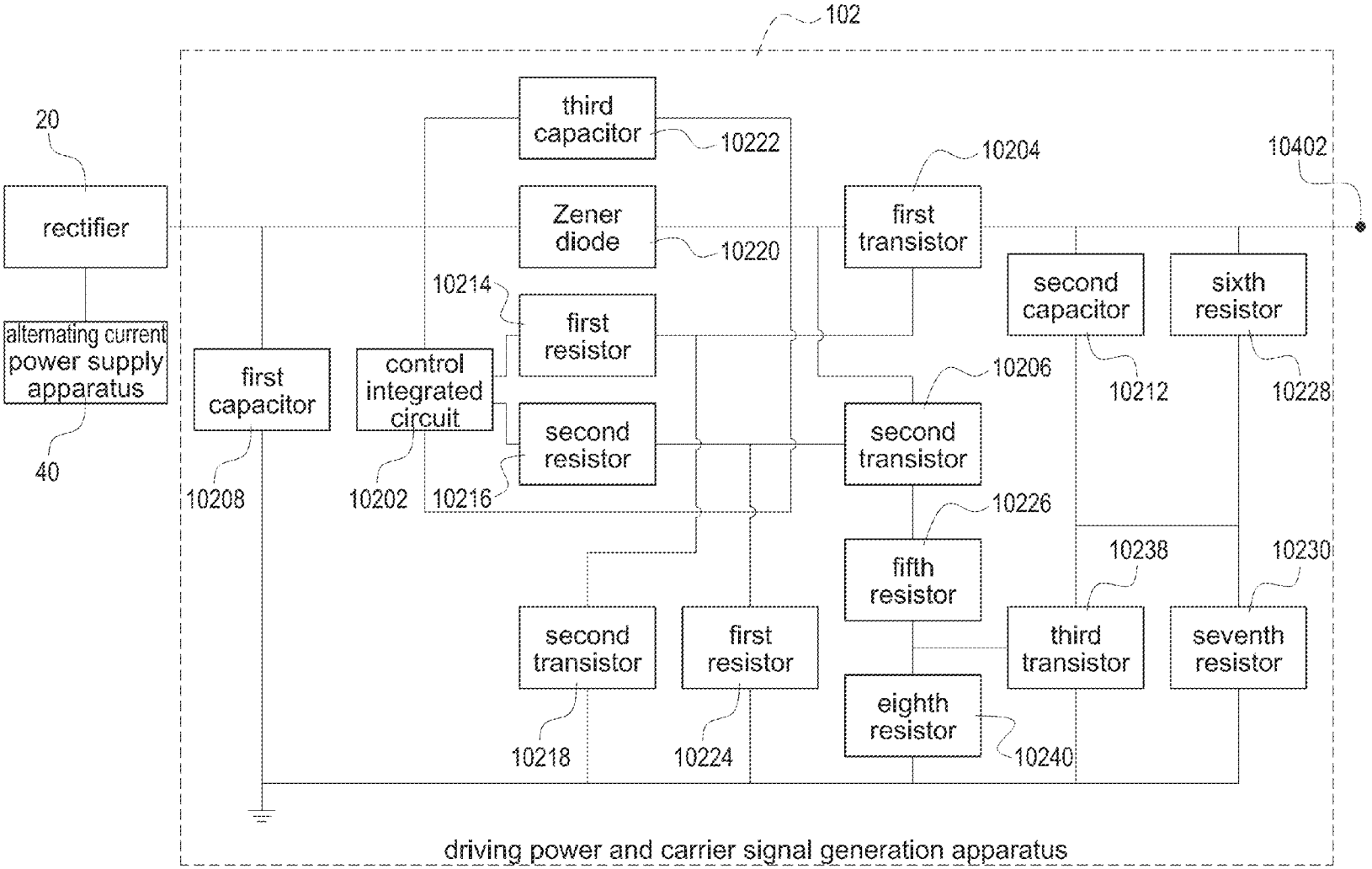
FIG. 10 shows a block diagram of the ninth embodiment of the driving power and carrier signal generation apparatus of the present invention.

FIG. 10 shows a block diagram of the ninth embodiment of the driving power and carrier signal generation apparatus of the present invention. The driving power and carrier signal generation apparatus 102 comprises a control integrated circuit 10202, a first transistor 10204, a second transistor 10206, a first capacitor 10208, a second capacitor 10212, a first resistor 10214, a second resistor 10216, a third resistor 10218, a Zener diode 10220, a third capacitor 10222, a fourth resistor 10224, a fifth resistor 10226, a sixth resistor 10228, a seventh resistor 10230, a third transistor 10238 and an eighth resistor 10240.

The control integrated circuit 10202 is electrically connected to the rectifier 20. The first resistor 10214 is electrically connected to the control integrated circuit 10202. The first transistor 10204 is electrically connected to the first resistor 10214 and the power positive terminal 10402. The first capacitor 10208 is electrically connected to the control integrated circuit 10202. The second capacitor 10212 is electrically connected to the first transistor 10204 and the power positive terminal 10402. The second resistor 10216 is electrically connected to the control integrated circuit 10202. The third resistor 10218 is electrically connected to the first resistor 10214. The Zener diode 10220 is electrically connected to the control integrated circuit 10202 and the first transistor 10204. The third capacitor 10222 is electrically connected to the Zener diode 10220. The second transistor 10206 is electrically connected to the second resistor 10216. The fourth resistor 10224 is electrically connected to the second resistor 10216. The fifth resistor 10226 is electrically connected to the second transistor 10206. The sixth resistor 10228 is electrically connected to the first transistor 10204 and the power positive terminal 10402. The seventh resistor 10230 is electrically connected to the sixth resistor 10228. The third transistor 10238 is electrically connected to the second capacitor 10212. The eighth resistor 10240 is electrically connected to the fifth resistor 10226.

Figure 11:
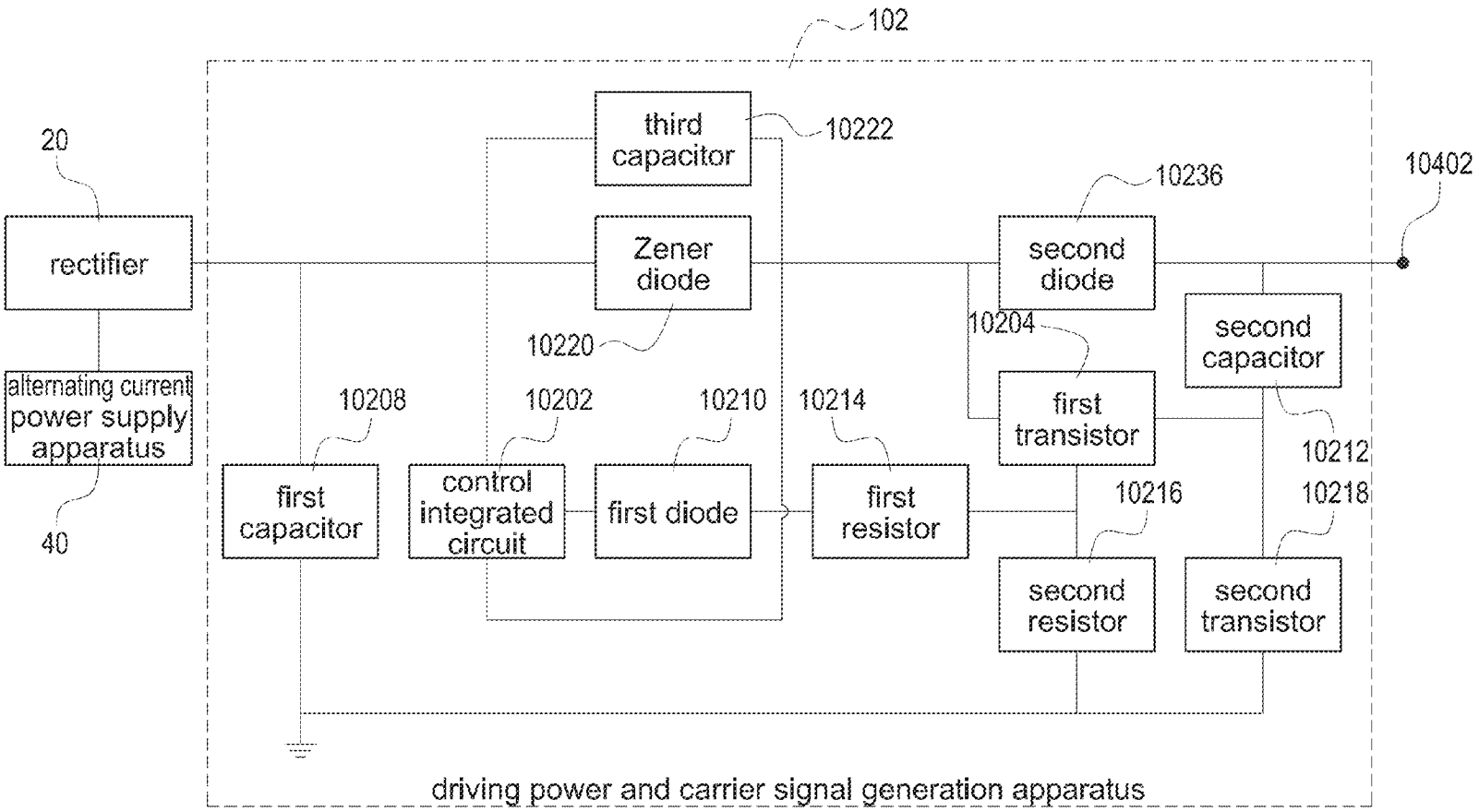
FIG. 11 shows a block diagram of the tenth embodiment of the driving power and carrier signal generation apparatus of the present invention.

FIG. 11 shows a block diagram of the tenth embodiment of the driving power and carrier signal generation apparatus of the present invention. The driving power and carrier signal generation apparatus 102 comprises a control integrated circuit 10202, a first transistor 10204, a first capacitor 10208, a first diode 10210, a second capacitor 10212, a first resistor 10214, a second resistor 10216, a third resistor 10218, a Zener diode 10220, a third capacitor 10222 and a second diode 10236.

The control integrated circuit 10202 is electrically connected to the rectifier 20. The first diode 10210 is electrically connected to the control integrated circuit 10202. The first resistor 10214 is electrically connected to the first diode 10210. The first transistor 10204 is electrically connected to the first resistor 10214. The first capacitor 10208 is electrically connected to the control integrated circuit 10202. The second capacitor 10212 is electrically connected to the first transistor 10204. The second resistor 10216 is electrically connected to the first transistor 10204. The third resistor 10218 is electrically connected to the second capacitor 10212. The Zener diode 10220 is electrically connected to the control integrated circuit 10202. The third capacitor 10222 is electrically connected to the Zener diode 10220. The second diode 10236 is electrically connected to the Zener diode 10220.

Figure 18:
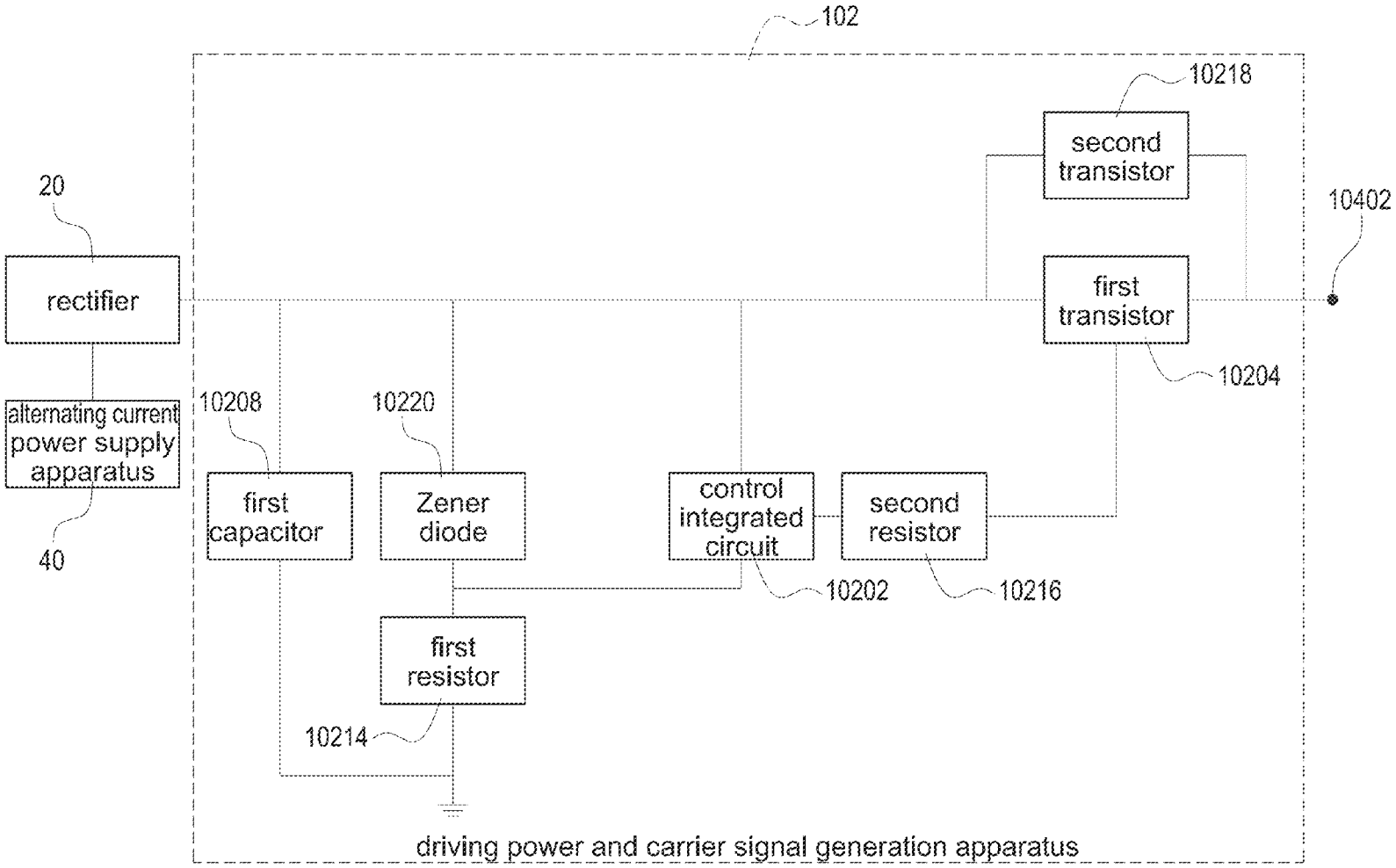
FIG. 18 shows a block diagram of the eleventh embodiment of the driving power and carrier signal generation apparatus of the present invention.

FIG. 18 shows a block diagram of the eleventh embodiment of the driving power and carrier signal generation apparatus of the present invention. The driving power and carrier signal generation apparatus 102 comprises a control integrated circuit 10202, a first transistor 10204, a first capacitor 10208, a first resistor 10214, a second resistor 10216, a third resistor 10218 and a Zener diode 10220.

The control integrated circuit 10202 is electrically connected to the rectifier 20. The first transistor 10204 is electrically connected to the rectifier 20, the power positive terminal 10402 and the control integrated circuit 10202. The first capacitor 10208 is electrically connected to the rectifier 20 and the control integrated circuit 10202. The first resistor 10214 is electrically connected to the control integrated circuit 10202. The second resistor 10216 is electrically connected to the control integrated circuit 10202 and the first transistor 10204. The third resistor 10218 is electrically connected to the rectifier 20, the power positive terminal 10402, the control integrated circuit 10202 and the first transistor 10204. The Zener diode 10220 is electrically connected to the control integrated circuit 10202, the first capacitor 10208 and the first resistor 10214.

Figure 12:
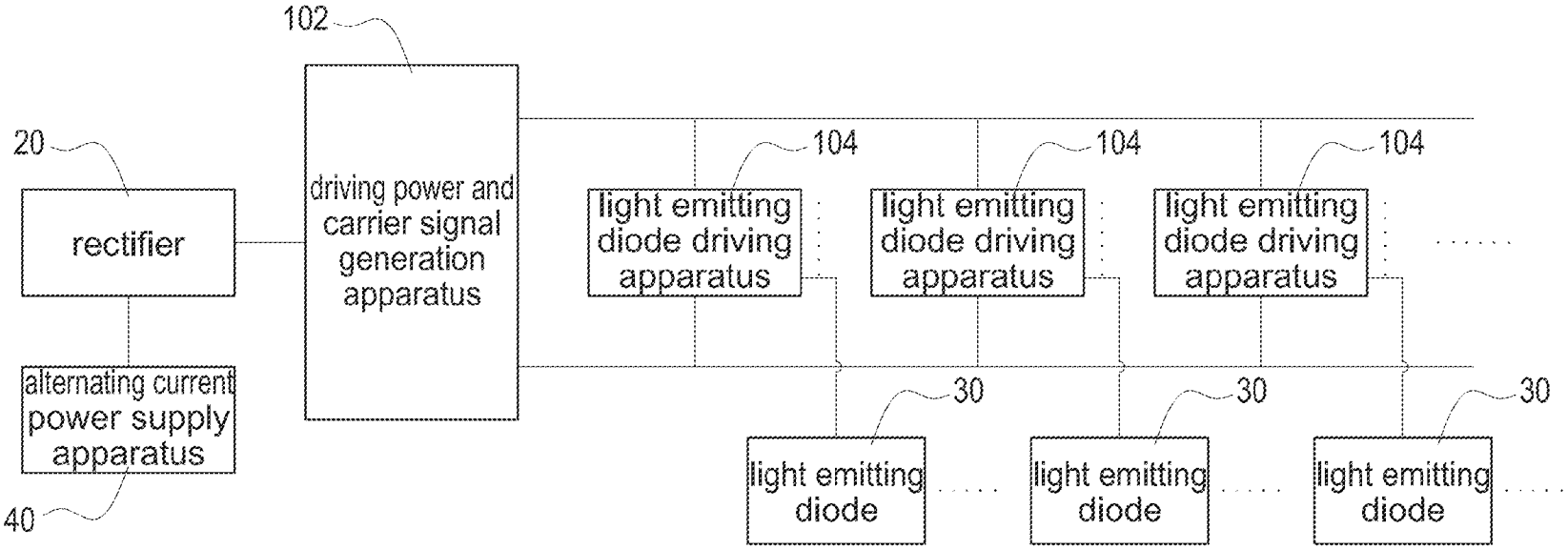
FIG. 12 shows a block diagram of an embodiment of the light emitting diode driving apparatuses in parallel.
Figure 13:
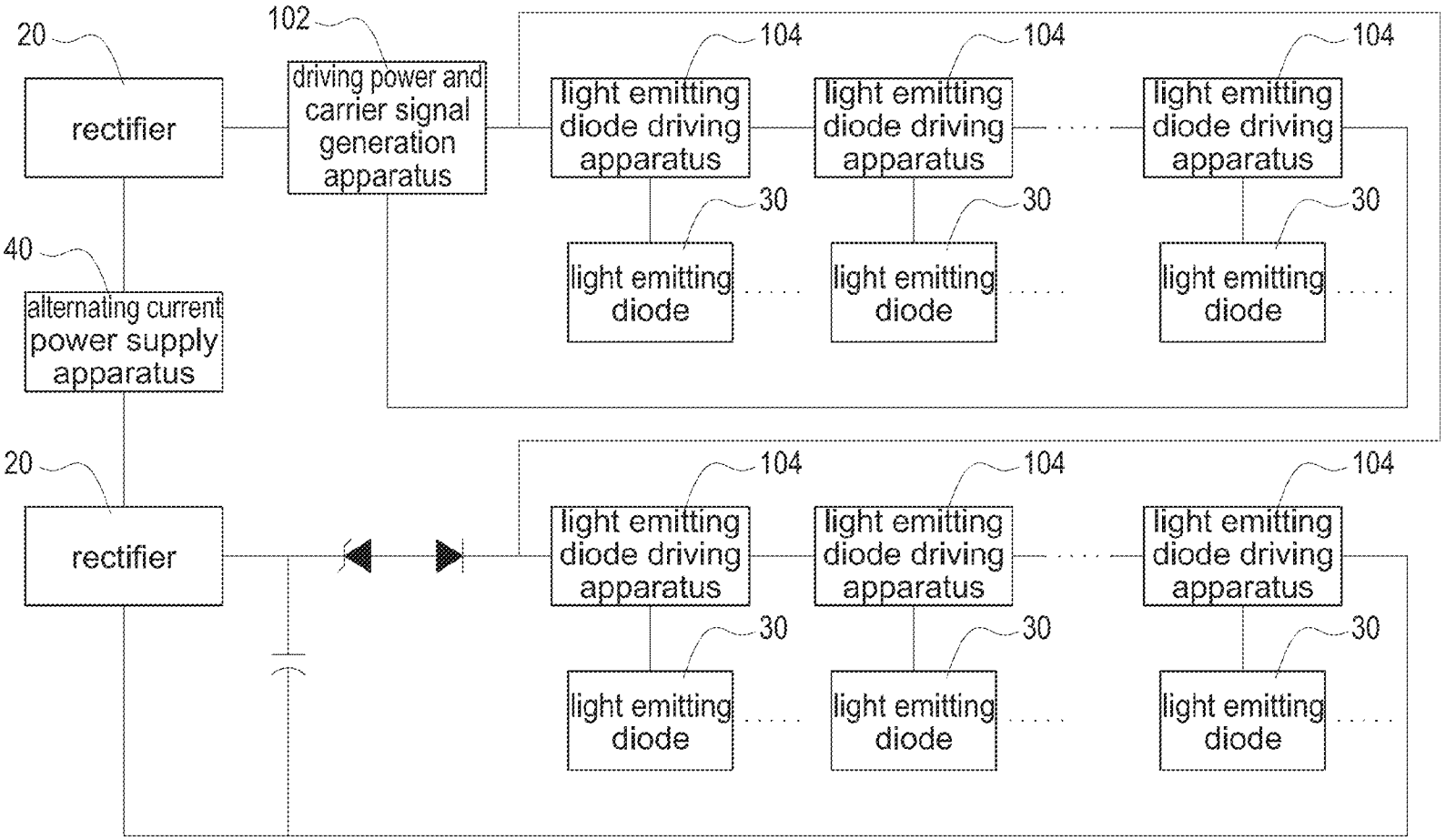
FIG. 13 shows a block diagram of an embodiment of the light emitting diode driving apparatuses in series.

FIG. 12 shows a block diagram of an embodiment of the light emitting diode driving apparatuses in parallel. FIG. 13 shows a block diagram of an embodiment of the light emitting diode driving apparatuses in series.

Figure 14:
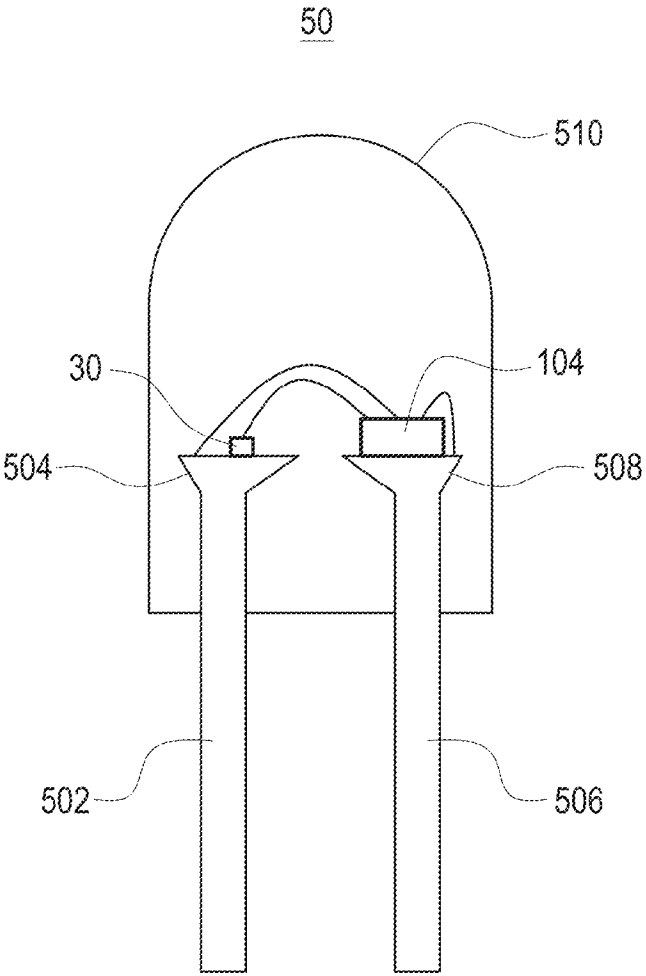
FIG. 14 shows a perspective view of the package structure of the present invention.

FIG. 14 shows a perspective view of the package structure of the present invention. A package structure 50 of the present invention comprises the light emitting diode driving apparatus 104 mentioned above.

The package structure 50 further comprises a first support 502, a first platform 504, a second support 506, a second platform 508, the light emitting diode 30 and a package 510.

The first platform 504 is arranged at one side of the first support 502. The second support 506 is arranged parallel to the first support 502. The second platform 508 is arranged at one side of the second support 506. The light emitting diode driving apparatus 104 is arranged on the second platform 508 and is electrically connected to the second platform 508. The light emitting diode 30 is arranged on the first platform 504 and is electrically connected to the first platform 504. The light emitting diode driving apparatus 104 is electrically connected to the light emitting diode 30. The package 510 covers the first platform 504, the second platform 508, the light emitting diode driving apparatus 104 and the light emitting diode 30.

Figure 15:
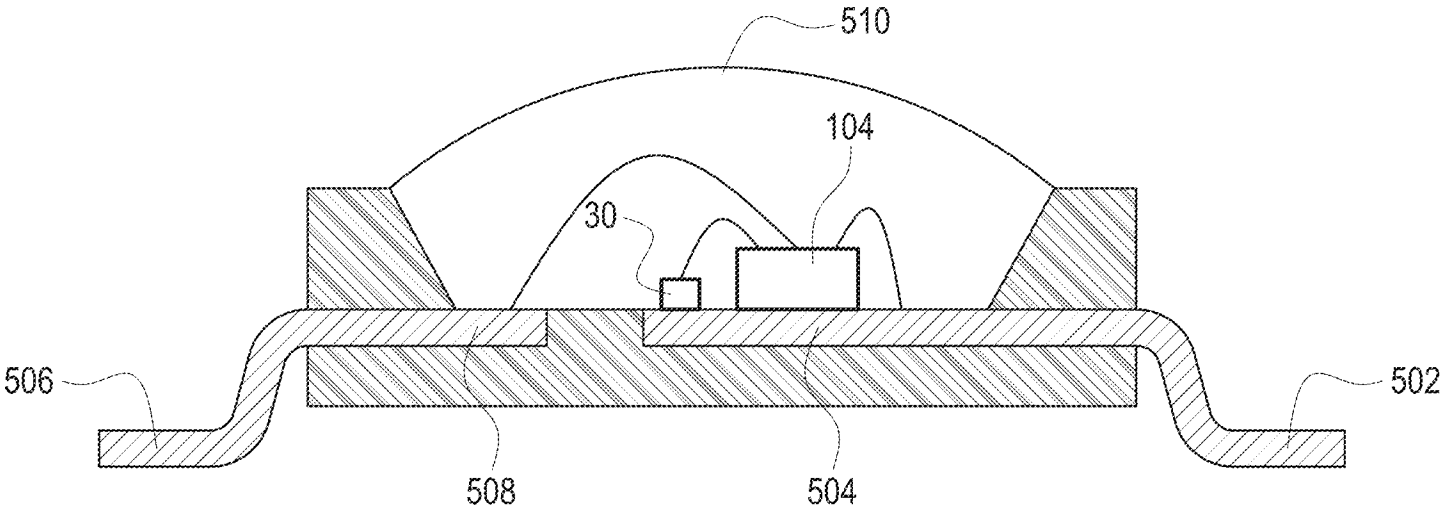
FIG. 15 shows a perspective view of another package structure of the present invention.

FIG. 15 shows a perspective view of another package structure of the present invention. A package structure 50 uses the surface mount technology. The description for the elements shown in FIG. 15, which are similar to those shown in FIG. 14, is not repeated here for brevity. Moreover, the light emitting diode 30 and the light emitting diode driving apparatus 104 are arranged on the first platform 504 and are electrically connected to the second platform 508 and the second support 506 through the light emitting diode driving apparatus 104.

Figure 16:
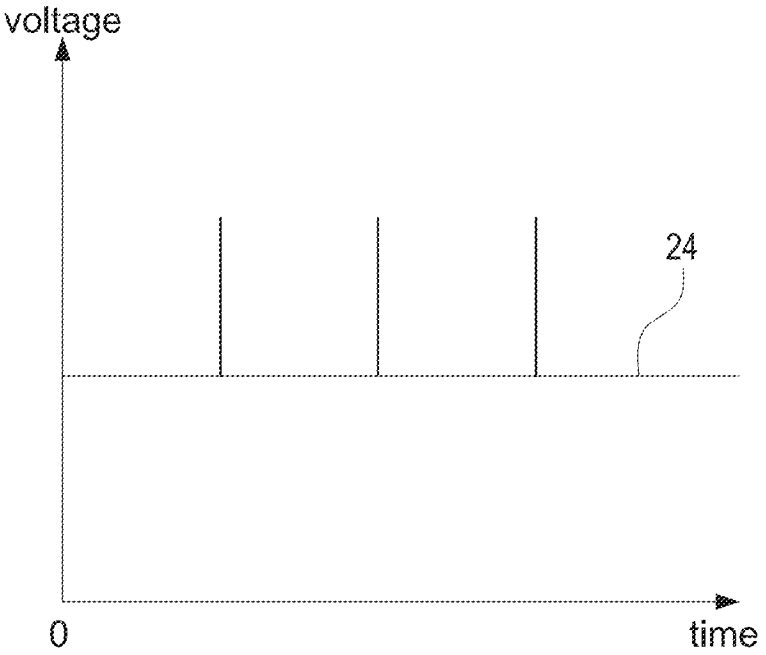
FIG. 16 shows a waveform diagram of the first embodiment of the carrier signal of the present invention.
Figure 19:
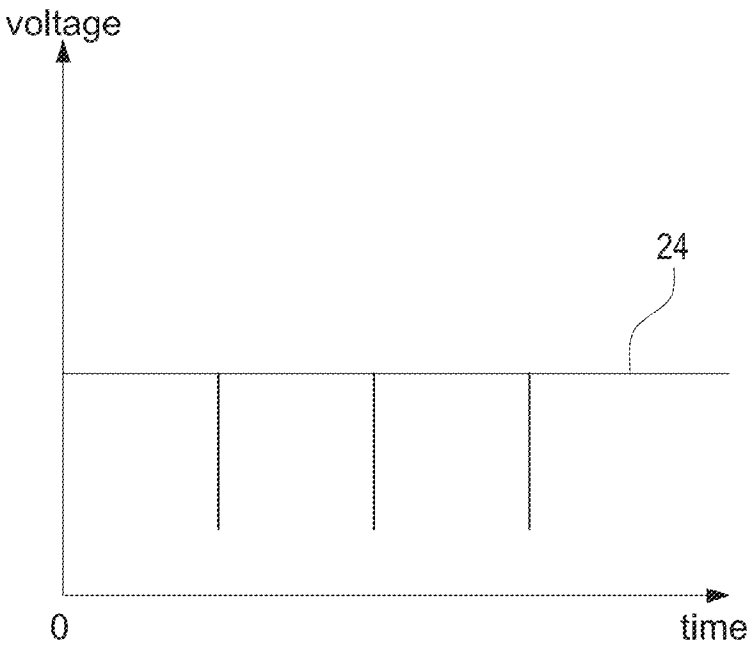
FIG. 19 shows a waveform diagram of the second embodiment of the carrier signal of the present invention.

FIG. 16 shows a waveform diagram of the first embodiment of the carrier signal of the present invention. FIG. 19 shows a waveform diagram of the second embodiment of the carrier signal of the present invention. The carrier signal 10234 shown in FIG. 16 and FIG. 19 comprises a single pulse wave when the carrier signal 10234 is generated and sent.

Figure 17:
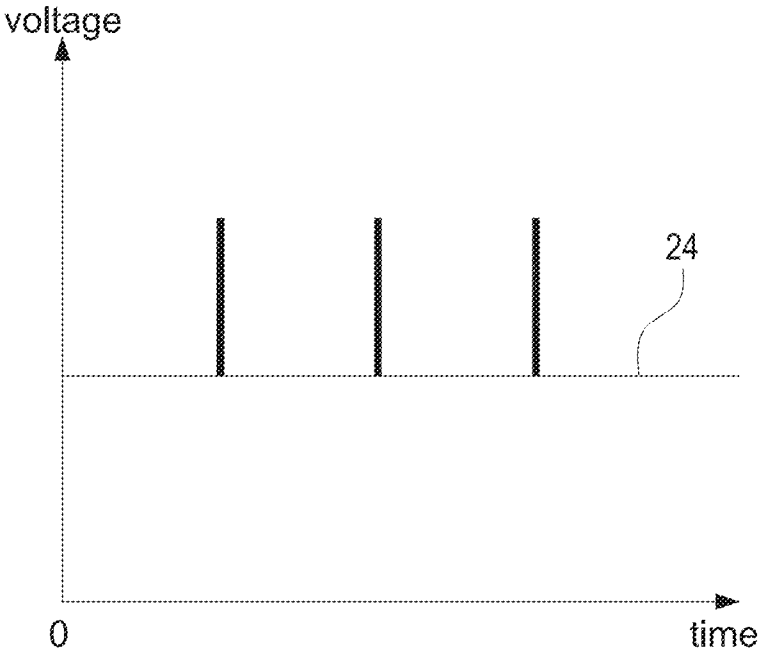
FIG. 17 shows a waveform diagram of the third embodiment of the carrier signal of the present invention.
Figure 20:
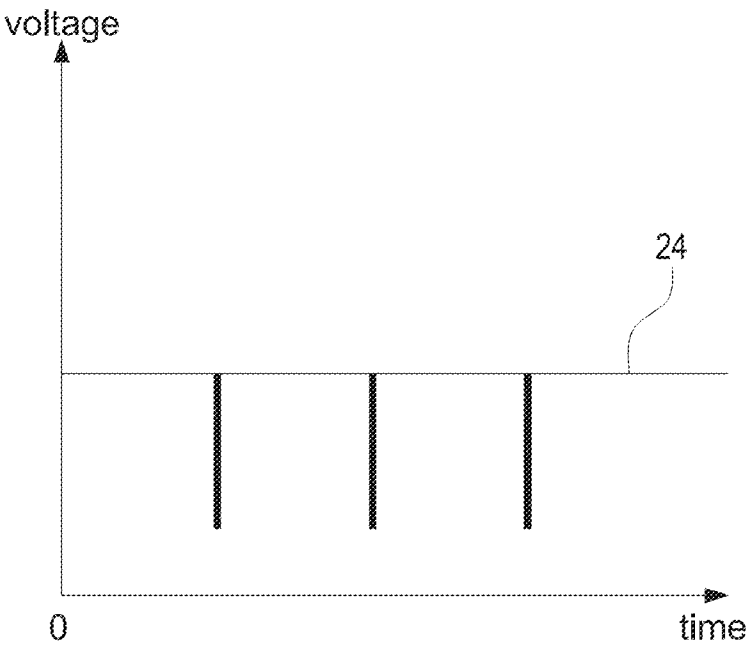
FIG. 20 shows a waveform diagram of the fourth embodiment of the carrier signal of the present invention.

FIG. 17 shows a waveform diagram of the third embodiment of the carrier signal of the present invention. FIG. 20 shows a waveform diagram of the fourth embodiment of the carrier signal of the present invention. The carrier signal 10234 shown in FIG. 17 and FIG. 20 comprises a plurality of pulse waves. Therefore, the light emitting diode driving apparatuses 104 drive the light emitting diodes 30 synchronously.

The advantage of the present invention is to reduce the transmission lines of the light emitting diode lamp. Therefore, the cost of the light emitting diode lamp is reduced.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode driving system, the light emitting diode driving system applied to a rectifier and at least a light emitting diode, the light emitting diode driving system comprising:

a driving power and carrier signal generation apparatus electrically connected to the rectifier;

a transmission line electrically connected to the driving power and carrier signal generation apparatus; and a plurality of light emitting diode driving apparatuses electrically connected to the transmission line, the driving power and carrier signal generation apparatus and the light emitting diodes, wherein the rectifier rectifies an alternating current power to obtain a direct current power; the rectifier sends the direct current power to the driving power and carrier signal generation apparatus; the driving power and carrier signal generation apparatus generates a driving power; the driving power and carrier signal generation apparatus sends the driving power through the transmission line to the light emitting diode driving apparatuses to drive the light emitting diodes;

wherein the driving power and carrier signal generation apparatus generates a carrier signal; the driving power and carrier signal generation apparatus sends the carrier signal through the transmission line to the light emitting diode driving apparatuses; each of the light emitting diode driving apparatuses receives the carrier signal from the transmission line and drives the light emitting diodes according to the carrier signal, wherein the light emitting diode driving apparatus comprises:

a power positive terminal electrically connected to the driving power and carrier signal generation apparatus;

a voltage regulator electrically connected to the power positive terminal;

a power negative terminal electrically connected to the voltage regulator;

a signal detector electrically connected to the power positive terminal;

an identification control logic circuit electrically connected to the voltage regulator, the power negative terminal and the signal detector;

a counting and shift-registering circuit electrically connected to the voltage regulator, the power negative terminal and the identification control logic circuit;

a light changing control circuit electrically connected to the voltage regulator, the power negative terminal and the counting and shift-registering circuit, the light changing control circuit configured to determine colors and intensities of the light emitting diodes;

a comparison circuit electrically connected to the identification control logic circuit;

an address memory unit electrically connected to the comparison circuit;

an address register electrically connected to the identification control logic circuit;

an oscillator electrically connected to the voltage regulator, the power negative terminal, the identification control logic circuit and the light changing control circuit;

a driving current control circuit electrically connected to the voltage regulator, the power negative terminal and the light changing control circuit; and at least a driving current output circuit electrically connected to the driving current control circuit and the light emitting diodes, wherein the signal detector detects the carrier signal and then the signal detector informs the identification control logic circuit; then the identification control logic circuit, the comparison circuit, the address memory unit and the address register are configured to control and process a circuit logic and then the counting and shift-registering circuit informs the light changing control circuit; then the light changing control circuit is configured to determine the colors and the intensities of the light emitting diodes and then the light changing control circuit informs the driving current control circuit; then the driving current control circuit is configured to control the driving current output circuit to drive the light emitting diodes.

2. The light emitting diode driving system in claim 1, wherein the driving power and carrier signal generation apparatus comprises:

a control integrated circuit electrically connected to the rectifier;

a first transistor electrically connected to the rectifier, the power positive terminal and the control integrated circuit;

a second transistor electrically connected to the rectifier, the power positive terminal and the control integrated circuit; and a first capacitor electrically connected to the first transistor, the second transistor and the power positive terminal.

3. The light emitting diode driving system in claim 1, wherein the driving power and carrier signal generation apparatus comprises:

a control integrated circuit electrically connected to the rectifier;

a first transistor electrically connected to the rectifier and the control integrated circuit;

a second transistor electrically connected to the control integrated circuit and the first transistor;

a first capacitor electrically connected to the rectifier and the control integrated circuit;

a first diode electrically connected to the rectifier, the power positive terminal and the control integrated circuit; and a second capacitor electrically connected to the first diode and the power positive terminal.

4. The light emitting diode driving system in claim 1, wherein the driving power and carrier signal generation apparatus comprises:

a control integrated circuit electrically connected to the rectifier;

a first transistor electrically connected to the rectifier and the control integrated circuit;

a second transistor electrically connected to the control integrated circuit and the first transistor;

a first capacitor electrically connected to the rectifier and the control integrated circuit;

a second capacitor electrically connected to the first transistor and the power positive terminal; and a first resistor electrically connected to the first transistor and the power positive terminal.

5. The light emitting diode driving system in claim 1, wherein the driving power and carrier signal generation apparatus comprises:

a control integrated circuit electrically connected to the rectifier;

a first transistor electrically connected to the rectifier and the control integrated circuit;

a first capacitor electrically connected to the rectifier and the control integrated circuit;

a first diode electrically connected to the rectifier, the power positive terminal and the control integrated circuit;

a second capacitor electrically connected to the first diode and the power positive terminal;

a second transistor electrically connected to the second capacitor;

a first resistor electrically connected to the rectifier and the control integrated circuit;

a second resistor electrically connected to the control integrated circuit, the first resistor and the first transistor; and a third resistor electrically connected to the control integrated circuit and the second transistor.

6. The light emitting diode driving system in claim 1, wherein the driving power and carrier signal generation apparatus comprises:

a control integrated circuit electrically connected to the rectifier;

a first transistor electrically connected to the rectifier and the control integrated circuit;

a first capacitor electrically connected to the rectifier and the control integrated circuit;

a first diode electrically connected to the rectifier, the power positive terminal and the control integrated circuit;

a second capacitor electrically connected to the first diode and the power positive terminal;

a first resistor electrically connected to the rectifier and the control integrated circuit;

a second resistor electrically connected to the control integrated circuit, the first resistor and the first transistor; and a third resistor electrically connected to the second capacitor.

7. The light emitting diode driving system in claim 1, wherein the driving power and carrier signal generation apparatus comprises:

a control integrated circuit electrically connected to the rectifier;

a first transistor electrically connected to the rectifier and the control integrated circuit;

a first capacitor electrically connected to the rectifier and the control integrated circuit;

a first diode electrically connected to the rectifier, the power positive terminal and the control integrated circuit;

a second capacitor electrically connected to the first diode and the power positive terminal;

a first resistor electrically connected to the first capacitor and the control integrated circuit;

a second resistor electrically connected to the control integrated circuit and the first transistor;

a third resistor electrically connected to the second capacitor;

a zener diode electrically connected to the control integrated circuit, the first capacitor and the first resistor; and a third capacitor electrically connected to the rectifier and the control integrated circuit.

8. The light emitting diode driving system in claim 1, wherein the driving power and carrier signal generation apparatus comprises:

a control integrated circuit electrically connected to the rectifier;

a first transistor electrically connected to the rectifier and the control integrated circuit;

a first capacitor electrically connected to the rectifier and the control integrated circuit;

a second capacitor electrically connected to the first transistor and the power positive terminal;

a first resistor electrically connected to the first capacitor and the control integrated circuit;

a second resistor electrically connected to the control integrated circuit and the first transistor;

a third resistor electrically connected to the control integrated circuit;

a zener diode electrically connected to the control integrated circuit, the first capacitor and the first resistor;

a third capacitor electrically connected to the rectifier and the control integrated circuit;

a second transistor electrically connected to the first transistor;

a fourth resistor electrically connected to the second transistor;

a fifth resistor electrically connected to the fourth resistor;

a sixth resistor electrically connected to the first transistor and the power positive terminal;

a seventh resistor electrically connected to the sixth resistor; and a third transistor electrically connected to the fourth resistor, the fifth resistor and the second capacitor.

9. The light emitting diode driving system in claim 1, wherein the driving power and carrier signal generation apparatus comprises:

a first resistor electrically connected to the rectifier;

a control integrated circuit electrically connected to the first resistor;

a first transistor electrically connected to the rectifier and the first resistor;

a first capacitor electrically connected to the first resistor;

a second capacitor electrically connected to the first transistor and the power positive terminal;

a second resistor electrically connected to the control integrated circuit;

a third resistor electrically connected to the control integrated circuit;

a zener diode electrically connected to the first resistor;

a third capacitor electrically connected to the rectifier and the first resistor;

a second transistor electrically connected to the second resistor;

a fourth resistor electrically connected to the first transistor;

a fifth resistor electrically connected to the fourth resistor, the first transistor and the second transistor;

a sixth resistor electrically connected to the first transistor and the power positive terminal;

a seventh resistor electrically connected to the sixth resistor; and a third transistor electrically connected to the third resistor and the second capacitor.

10. The light emitting diode driving system in claim 1, wherein the driving power and carrier signal generation apparatus comprises:

a control integrated circuit electrically connected to the rectifier;

a first resistor electrically connected to the control integrated circuit;

a first transistor electrically connected to the first resistor and the power positive terminal;

a first capacitor electrically connected to the control integrated circuit;

a second capacitor electrically connected to the first transistor and the power positive terminal;

a second resistor electrically connected to the control integrated circuit;

a third resistor electrically connected to the first resistor;

a zener diode electrically connected to the control integrated circuit and the first transistor;

a third capacitor electrically connected to the zener diode;

a second transistor electrically connected to the second resistor;

a fourth resistor electrically connected to the second resistor;

a fifth resistor electrically connected to the second transistor;

a sixth resistor electrically connected to the first transistor and the power positive terminal;

a seventh resistor electrically connected to the sixth resistor;

a third transistor electrically connected to the second capacitor; and an eighth resistor electrically connected to the fifth resistor.

11. The light emitting diode driving system in claim 1, wherein the driving power and carrier signal generation apparatus comprises:

a control integrated circuit electrically connected to the rectifier;

a first diode electrically connected to the control integrated circuit;

a first resistor electrically connected to the first diode;

a first transistor electrically connected to the first resistor;

a first capacitor electrically connected to the control integrated circuit;

a second capacitor electrically connected to the first transistor;

a second resistor electrically connected to the first transistor;

a third resistor electrically connected to the second capacitor;

a zener diode electrically connected to the control integrated circuit;

a third capacitor electrically connected to the zener diode; and a second diode electrically connected to the zener diode.

* * * * *